United States Patent [19]

Gori

[11] Patent Number: 4,945,931

[45] Date of Patent: Aug. 7, 1990

[54] SIMULATED SMOKING DEVICE

[75] Inventor: Gio B. Gori, Bethesda, Md.

[73] Assignee: Brown & Williamson Tobacco Corporation, Louisville, Ky.

[21] Appl. No.: 379,831

[22] Filed: Jul. 14, 1989

[51] Int. Cl.[5] ..... A24B 15/00

[52] U.S. Cl. ..... 131/335; 131/194; 131/271; 131/273

[58] Field of Search ..... 131/331, 271, 273, 194, 131/335, 333

[56] References Cited

U.S. PATENT DOCUMENTS

| | | | |
|---|---|---|---|
| 3,200,819 | 8/1965 | Gilbert | 131/273 X |
| 4,171,000 | 10/1979 | Uhle | 131/273 |
| 4,393,884 | 7/1983 | Jacobs | 131/273 |

*Primary Examiner*—V. Millin
*Assistant Examiner*—J. L. Doyle
*Attorney, Agent, or Firm*—Charles G. Lamb

[57] ABSTRACT

A simulated smoking device includes a hollow tube with a capsule of pressurized aerosol generating material located inside the tube. An air flow passage is defined between the capsule and tube wall. The capsule includes an aerosol outlet port having a valve for selectively opening and closing the outlet port. An air operated valve activator is located inside the tube downstream of the air flow passage and is operatively connected to the valve. An aerosol passage communicates with the aerosol outlet port of the capsule and has a discharge end downstream of the air passage. Air is drawn into the tube, passes through the air passages, and impacts the air operated valve activator causing the valve to move opening the aerosol outlet port of the capsule releasing aerosol into the air flow downstream of the air operated valve activator.

10 Claims, 2 Drawing Sheets

SIMULATED SMOKING DEVICE

BACKGROUND OF THE INVENTION

The present invention relates to a simulated smoking device such as a cigarette which provides for the release of an aerosol into the user's mouth upon drawing on one end of the simulated smoking device, and more particularly, to such a device including a cylindrical tube having a capsule of pressurized aerosol inside the tube with a valve to control the flow of aerosol from the capsule into the tube as the user draws on one end of the tube.

Simulated smoking devices utilizing sources of aerosol generating material are, per se, known. The following U.S. Patents each show a different example of such devices: U.S. Pat. No. 2,764,154, issued on Sept. 25, 1956 to Hirotada Murai; U.S. Pat. No. 2,830,597, issued on Apr. 15, 1958 to J. Kummli; U.S. Pat. No. 3,631,856, issued on Jan. 4, 1972 to Harold V. Taylor; and, U.S. Pat. No. 4,393,884, issued on July 19, 1983 to Allen W. Jacobs.

SUMMARY OF THE INVENTION

The present invention provides a simulated smoking device which can be configured to physically resemble a cigarette or cigar. The simulated smoking device comprises a cylindrical tube having an air inlet end and an aerosol-air outlet end, a capsule containing a pressurized aerosol generating material located inside the tube, an air flow passage between the capsule and the wall of the tube in air flow communication with the air inlet end of the tube and the air-aerosol outlet end of the tube, an aerosol outlet port in the capsule, a valve at the aerosol outlet port for selectively opening and closing the port to allow pressurized aerosol generating material to flow out of the capsule through the port and closing the port to prevent the flow of pressurized aerosol generating material from the capsule, an air operated valve activator located in the tube downstream of the air flow passage and operatively associated with the valve so that the air flowing from the air passage operates the valve activator to open the valve, and an aerosol passage communicating at an inlet end with the aerosol outlet port of the capsule and having a discharge end downstream of the valve activator.

BRIEF DESCRIPTION OF THE DRAWINGS

A better understanding of the invention will be had upon reference to the following description in conjunction with the accompanying drawings wherein like numerals refer to like parts throughout the several views and in which.

DETAILED DESCRIPTION OF THE PREFERRED EMBODIMENT

Figure 1:
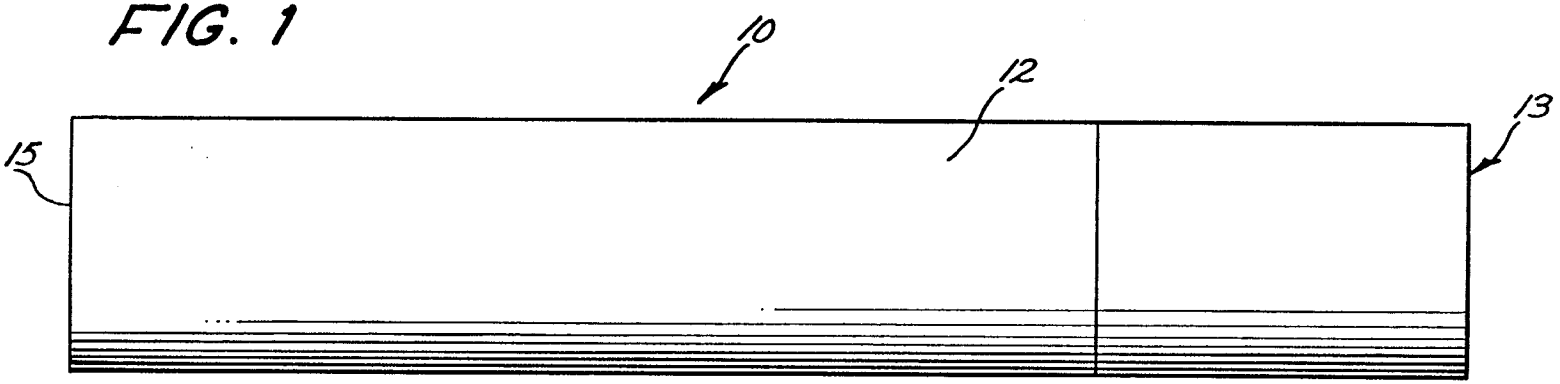
FIG. 1 is a side view of a simulated smoking device of the present invention.

With reference to FIG. 1, there is shown a side view of a simulated smoking device 10 of the present invention which physically resembles a cigarette.

Figure 2:
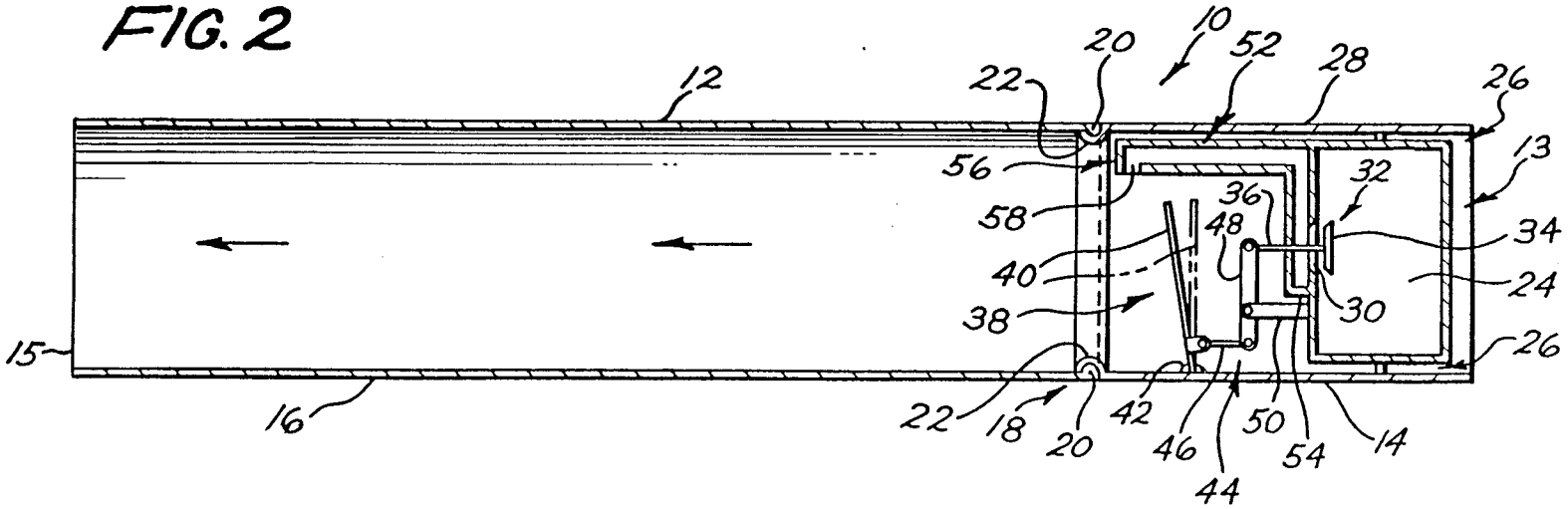
FIG. 2 is an enlarged longitudinal cross-sectional view of one embodiment of the present invention.

With reference to FIG. 2, the simulated smoking device 10 comprises a hollow tube 12 having an open air inlet end 13 and an open aerosol-air outlet end 15 which is formed of a first tube section 14 and a second tube section 16 connected together in coaxial relationship. Attachment means 18 are provided so that the first tube section 14 and second tube section 16 can be removably attached to each other. As shown, the attachment means 18 includes projections 20 attached to and extending radially inwardly from the interior surface of the second tube section 16, and resilient snaps 22 configured to receive the projections 20 at the exterior side of the first tube section 14. Due to the resilient property of the snaps 22, the first and second tube sections 14, 16 are attached together by merely moving these tube sections longitudinally toward each other until the snaps 22 engage the projections 20, and can be detached from each other by merely pulling the first and second tube sections 14, 16 longitudinally away from each other until the snaps 22 disengage from the projections 20.

A capsule 24 is located inside the first tube section 14 and cooperates with the interior surface of the first tube section 14 to define at least one air flow passage 26 therebetween. As shown, the capsule 24 can be attached to the first tube section 14 by, for example, a flange 28. The air flow passage 26 is in air flow communication with the air inlet end 13 of the tube 12 and is in air flow communication with the interior of the tube 12 such that it is also in air flow communication with the air-aerosol outlet end 15 of the tube 12. The capsule 24 contains an aerosol generating material under pressure. Various aerosol generating materials can be used, such as, for example, glycerin. The aerosol generating material can also be mixed with various flavorants such as, for example, menthol.

The capsule 24 includes an aerosol outlet port 30 and valve means 32 disposed at the aerosol outlet port 30 for selectively opening the port 30 allowing pressurized aerosol generating material to flow from the capsule 24 through the port 30, and closing the port 30 preventing pressurized aerosol generating material from flowing from the capsule 24. The valve means 32 is shown as having a valve head 34 located inside the capsule 24 with a valve stem 36 extending outwardly therefrom through the port 30. The valve head 34 has a larger area than the port 30 and when closed seals against the peripheral margin of the port 30. The valve means 32 is opened by moving the valve head 34 inwardly of the capsule 24 away from sealing contact with the peripheral margin of the port 30 to allow aerosol generating material to flow from the capsule 24 through the port 30 between the peripheral margin of the port and the valve head 34.

An air operated valve activation means, generally denoted as the numeral 38, is located downstream of the air flow passage and is operatively associated with the valve means 32. The air operated valve activation means 38 includes a movable vane member 40 positioned in the path of the air flowing from the air flow passage 26 so that at least a portion of the air from the air passage 26 impacts the vane member 40 and causes it to be displaced from a neutral position. The vane member 40 can be a flexible diaphragm or a reed which is displaced by the air flow, but is shown as being pivotally attached at a hinge joint 42 to the interior surface of the tube 12 and, more particularly, to the interior wall surface of the first tube section 14. The vane member 40 is interconnected with the valve means 32 by linkage, generally denoted as the numeral 44 so that as the vane member 40 moves it causes the valve means 32 to move between the open and closed position. As shown, the linkage 44 is a two bar mechanism having a first bar 46 pivotally attached at its proximal end to the vane member 40, and a second bar 48 pivotally attached at its proximal end to the stem 36 of the valve means 32, with the distal ends of the first and second bars pivotally attached together. A bracket 50 is attached at its proximal end to the capsule 24 and is pivotally attached at its distal end to the second bar 48 between the ends of the second bar 48. Thus, as the vane member 40 is pivoted in a direction away from the capsule 24, the two bar linkages 44 push the valve means 32 in a direction inwardly of the capsule 24 moving the valve head 34 away from sealing contact with the peripheral margin of the port 30 against the force exerted by the pressurized aerosol generating material inside the capsule 24. When at least a portion of the air flowing from the air flow passage 26 impacts the vane member 40, it imparts a force against the vane member 40 in a direction away from the capsule 24 sufficient to move the vane member 40 causing the valve means 32 to open. In the absence of air flow, the force on the valve head 34 exerted by the compressed aerosol generating material inside the capsule 24 closes the valve means 32 by forcing the valve head 34 tightly and in sealing contact with the peripheral margin of the port 30.

An aerosol passage, generally denoted as the numeral 52, communicates at its inlet end 54 with the outlet port 30 and has its discharge end 56 located downstream of the valve activation means 38. As shown, the valve stem 36 of the valve means 32 projects through the wall of the aerosol passage 52. An appropriate seal can be located around the valve stem 36 to prevent leakage of the aerosol generating material. The discharge end 56 of the aerosol passage 52 includes a nozzle 58 to increase the velocity of the exiting aerosol generating material and to aerosolize the aerosol generating material.

Figure 3:
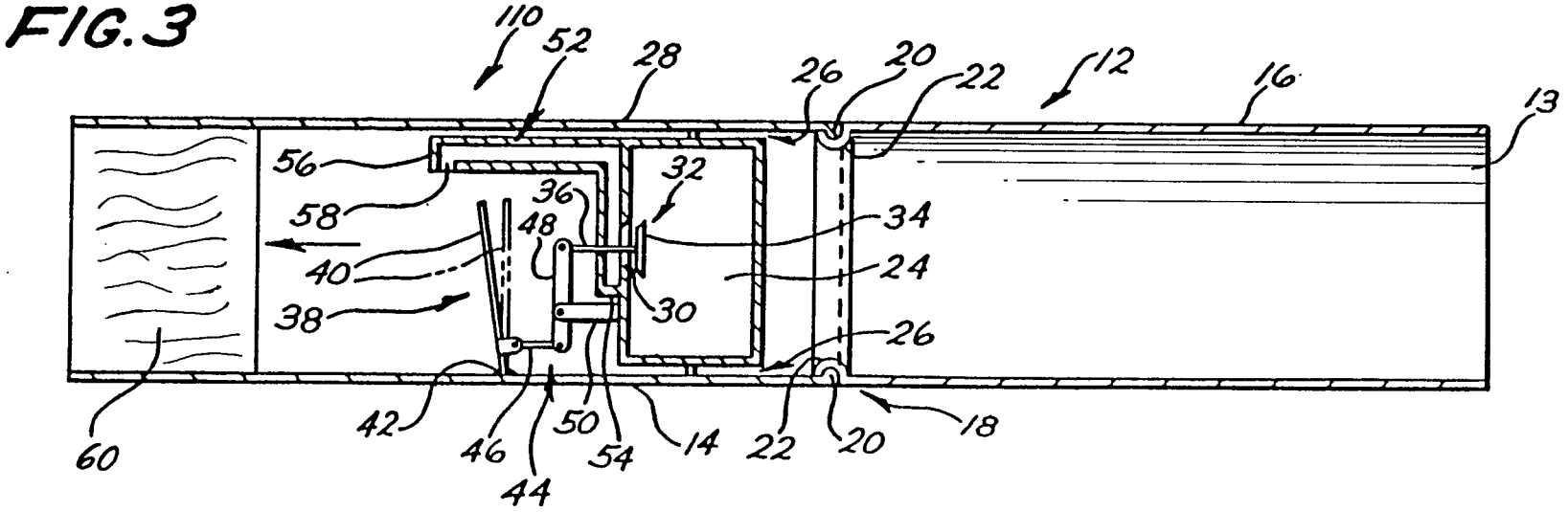
FIG. 3 is an enlarged longitudinal cross-sectional view of another embodiment of the present invention; and, FIG. 4 is an enlarged longitudinal cross-sectional view of yet another embodiment of the present invention.

FIG. 3 illustrates a smoking device 110 which has many features in common with the smoking device of FIG. 2. Therefore, the common features are identified by common numerals and, for the sake of brevity, the description of the common features will not be repeated. In comparing the smoking device 110 with the smoking device 10 it can be seen that in the smoking device 110 the first tube section 14 having the capsule 24 and valve means 32 is located in back of the second tube section 16 whereas in the smoking device 10 relative positions of the first and second tube sections are reversed such that the first tube second 14 having the capsule 24 and valve means 32 is located in front of the second tube 16. With continued reference to FIG. 3, the simulated smoking device 110 further includes a filter rod 60 at the outlet end of the first tube section 14 downstream of discharge end 56 of the aerosol passage 52. The filter rod 60 provides a draw effort corresponding to the draw effort of a conventional cigarette.

Figure 4:
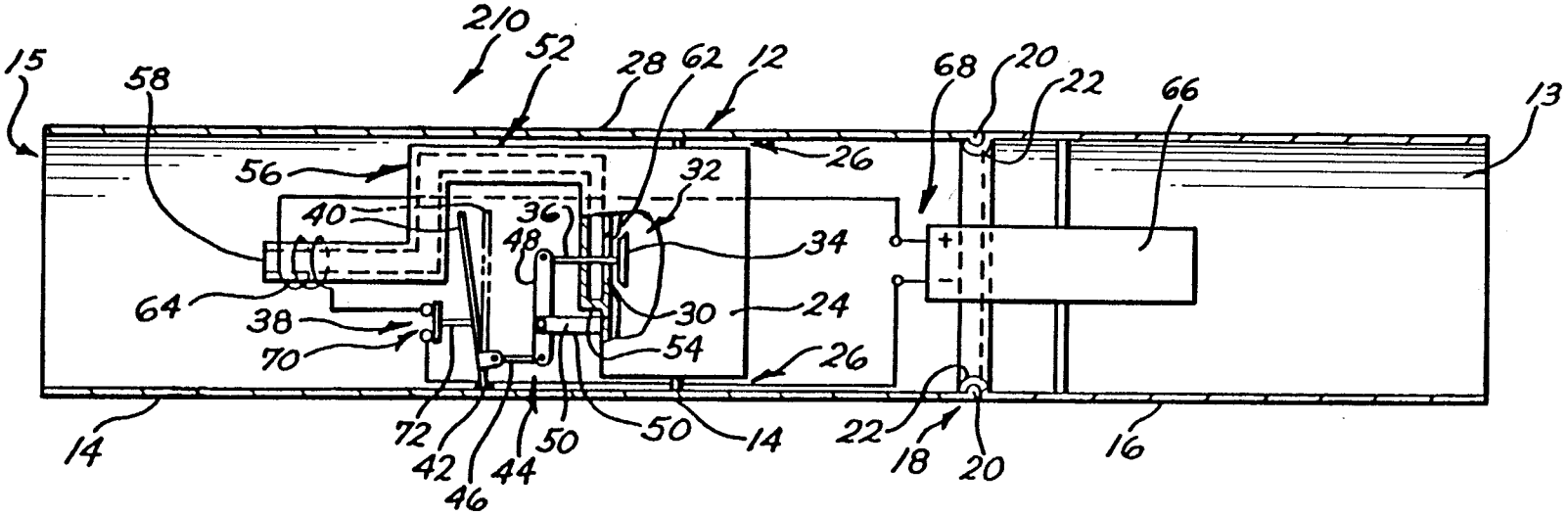

FIG. 4 illustrates a smoking device 210 which has many features in common with the smoking device 10 of FIG. 2 and more particularly with the smoking device 110 of FIG. 3. Therefore, the common features are identified by common numerals and, for the sake of brevity, the description of the common features will not be repeated.

The smoking device 210 includes a bladder 62 located inside the capsule 24. The bladder 62 has an outlet port in registration with the outlet port 30 of the capsule 24. The valve head 34 opens and closes the outlet port of the bladder. The bladder 62 contains the aerosol generating material to be released through the outlet port. A gas, or liquid is contained between the wall of the capsule 24 of the wall of the bladder 62 to exert a pressure on the bladder 62 and, therefore, on the aerosol generating material within the bladder 62 to force the aerosol generating material out of the outlet port when the valve head 34 is in the open position.

The smoking device 210 also includes aerosol heating means, generally denoted as the numeral 64, for heating the aerosol as it flows in the aerosol passage 52 to the discharge end 56. This may be desirable to heat the aerosol generating material to further promote vaporization thereof. Toward this objective, the heating means 64 is shown as comprising an electrical heater around the aerosol passage 52 such as coils of electrical resistance wire. A small electrical battery 66 can be located with the second tube section 16 to provide the current through an appropriate circuit 68 for heating the electrical heater 64. Small batteries such as an AAA size or even an AA size are suitable. The flow of current can be controlled by a switch 70 located in the circuit 68. The switch 70 can be operatively associated with the air operated valve activation means 38 to close the switch 70 when the valve means 32 opens and to open the switch 70 when the valve means 32 closes. This can be accomplished by, for example, a link 72 connecting the switch 70 to the vane member 40 so that the switch 70 moves between its open and closed positions as the vane member 40 is moved by the air flow from passage 26.

As the user draws on the mouth end of the simulated smoking device 10, 110 ambient air is drawn through the flow passage 26, and at least a portion of the air impacts the vane member 40 which causes the valve means 32 to open. The open valve means 32 allows the pressurized aerosol generating material to flow from the capsule 24 through the aerosol passage 52 and through the nozzle 58 whereupon the aerosol generating material is aerolized and mixes with the air downstream of the valve activator means 38 before entering the user's mouth.

The foregoing detailed description is given primarily for clearness of understanding and no unnecessary limitations should be understood therefrom for modifications will become obvious to those skilled in the art upon reading this disclosure and may be made without departing from the spirit of the invention or the scope of the appended claims.

What is claimed is:

1. A simulated smoking device comprising:

a cylindrical tube having a sidewall, an air inlet end and an aerosol air outlet end;

a capsule having a sidewall and containing pressurized aerosol generating material located in the tube;

means defining an air flow passage between and defined by the sidewall of the capsule and sidewall of the tube, the air flow passage being in flow communication with the air inlet end of the tube and the aerosol air outlet end of the tube;

an aerosol outlet port formed in the capsule;

valve means disposed at the aerosol outlet port for selectively opening the port allowing pressurized aerosol generating material to flow from the capsule through the open port and closing the port preventing pressurized aerosol generating material from flowing from the capsule;

air operated valve activation means located within the tube downstream of the air flow passage and operatively associated with the valve means, so that the air flowing from the air flow passage operates the valve activation means to open the valve means; and, an aerosol passage communicating at an inlet end with the aerosol outlet port of the capsule and having a discharge end downstream of the valve activation means.

2. The simulated smoking device of claim 1, further comprising a nozzle at the discharge end of the aerosol passage to increase the exiting velocity of the aerosol generating material and to aerosolize the aerosol generating material.

3. The simulated smoking device of claim 1 further comprising:

a first cylindrical tube section;

a second cylindrical tube section coaxially disposed with the first cylindrical tube section; and, means for removably attaching the first and second tube section together in coaxial relationship.

4. The simulated smoking device of claim 3, wherein the first tube is coaxially located at the inlet end of the second tube.

5. The simulated smoking device of claim 3, wherein the first tube is coaxially located at the outlet end of the second tube.

6. The simulated smoking device of claim 1, a fuel source disposed downstream of the air flow passage to preheat the air before the air enters the air flow passage.

7. The simulated smoking device of claim 1, further comprising means for heating the aerosol passage.

8. The simulated smoking device of claim 7, wherein the heating means comprises an electrical resistance heater.

9. The simulated smoking device of claim 8, further comprising a battery disposed in the cylindrical tube.

10. The simulated smoking device of claim 1, wherein the capsule includes a collapsible bladder for containing the aerosol generating material, and a fluid between the capsule walls and bladder walls for pressurizing the aerosol generating material within the bladder.

* * * * *